United States Patent [19]

Richards

[11] 4,237,341

[45] Dec. 2, 1980

[54] PORTABLE SELF-CONTAINED AMPLIFIER AND LOUDSPEAKER APPARATUS

[76] Inventor: Paul E. Richards, 12908 Piccadilly Cir. #2, Shawnee Mission, Kans. 66215

[21] Appl. No.: 945,640

[22] Filed: Sep. 25, 1978

[51] Int. Cl.[3] ..... H04R 27/04

[52] U.S. Cl. ..... 179/1 MG; 179/1 MN

[58] Field of Search ..... 179/1 MG, 1 R, 157, 179/1 AT, 1 MF, 100.1 C, 1 E, 1 M, 146 H; 325/16, 118; 84/361, 362, DIG. 1, DIG. 27, DIG. 29; 360/12; 181/141, 144, 147; 455/89, 95, 100

[56] References Cited

U.S. PATENT DOCUMENTS

| | | | |
|---|---|---|---|
| 2,541,042 | 2/1951 | Curtis | 179/157 |
| 2,571,514 | 10/1951 | Andrews | 179/157 |
| 2,676,207 | 4/1954 | Hunt | 179/1 MG |
| 3,268,030 | 8/1966 | Magnus | 181/147 |
| 3,385,393 | 5/1968 | Gold | 181/141 |
| 3,475,066 | 10/1969 | Billingsley et al. | 181/144 |
| 4,020,284 | 4/1977 | Phillips | 179/1 E |
| 4,084,139 | 4/1978 | Jakobe | 325/16 |

FOREIGN PATENT DOCUMENTS

| | | | |
|---|---|---|---|
| 2621516 | 1/1977 | Fed. Rep. of Germany | 360/12 |

*Primary Examiner*—Robert S. Tupper

*Assistant Examiner*—Randall P. Myers

*Attorney, Agent, or Firm*—Roger A. Marrs

[57] ABSTRACT

A portable self-contained amplified and loud speaker system and apparatus is disclosed herein having improved acoustical energy propagation in connection with musical sound distribution by a musician in a marching band or group. The apparatus includes cylindrical housing provided with shoulder and waist straps and a removable back plate shaped to fit the small of the back of the person wearing the housing. An electronic component package is secured within the housing so that a control panel is exposed for volume adjustment, recording tape insertion, start/stop switches and the like. Loudspeakers are angularly fixed to the opposite ends of the housing so as to close the ends thereof and are operably coupled to the components carried in the package for radiating acoustical energy in response to amplification of electrical signals processed by the components in a predetermined propagation pattern. The housing embodies an elongated tone chamber defined between the pair of end loudspeakers and a sound opening with a grill thereover is provided in the housing at the rear thereof which constitutes a third loudspeaker. The pair of end loudspeakers are wired "out-of-phase acoustically" whereby sound is radiated out of the rear speaker on the back stroke of the end speaker cones.

15 Claims, 13 Drawing Figures

FIG. 1
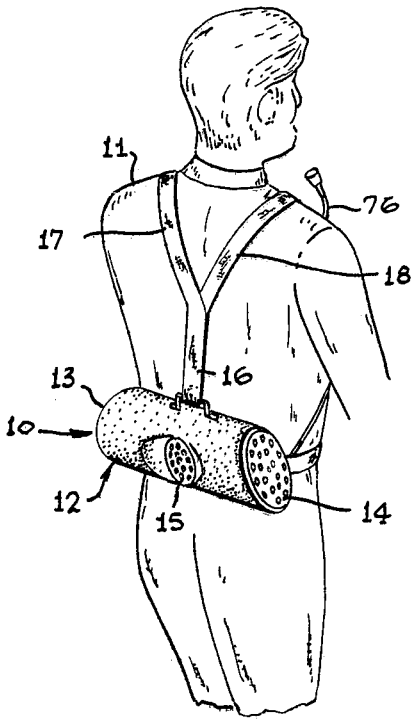
FIG. 2
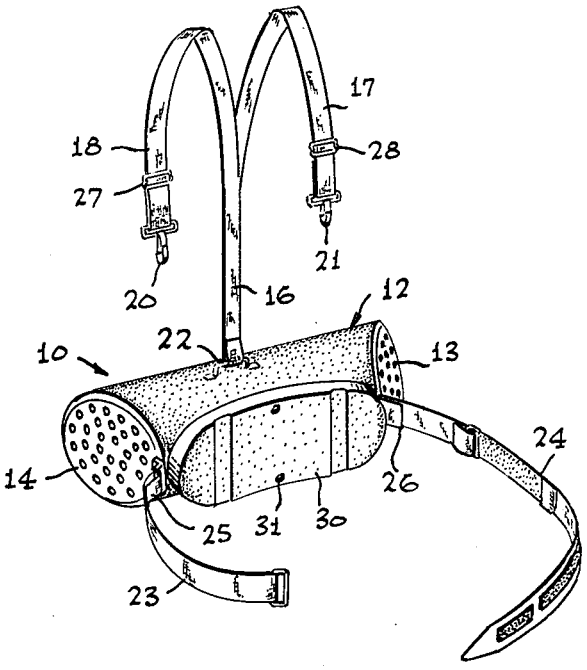
FIG. 3
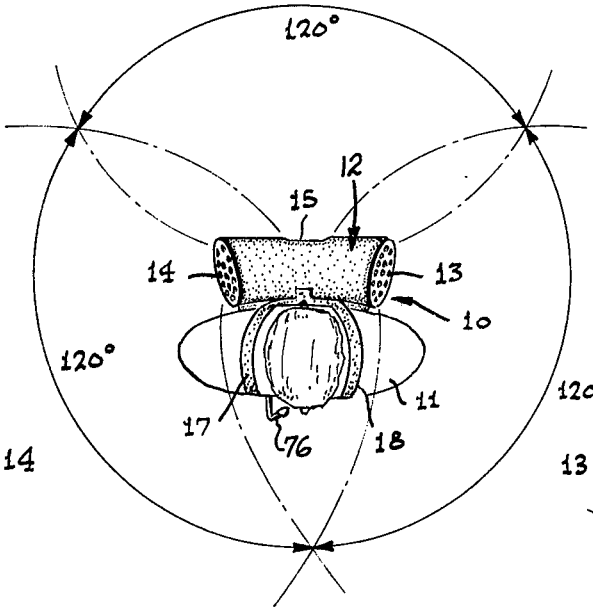
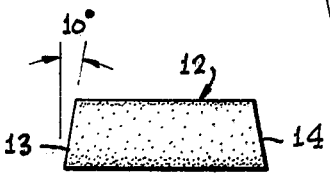
FIG. 4
FIG. 5
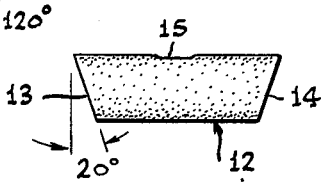

FIG. 11
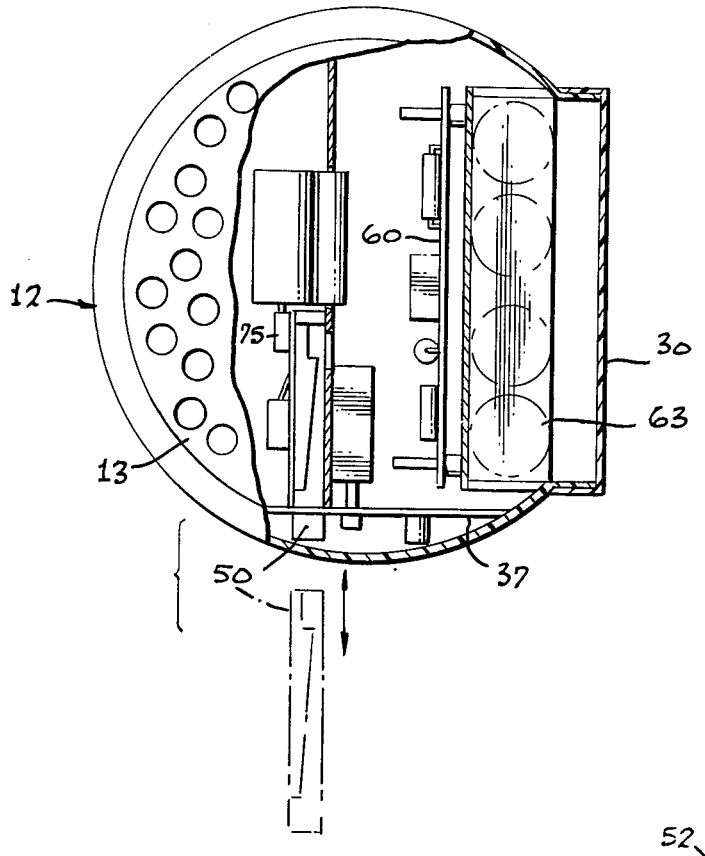
FIG. 13
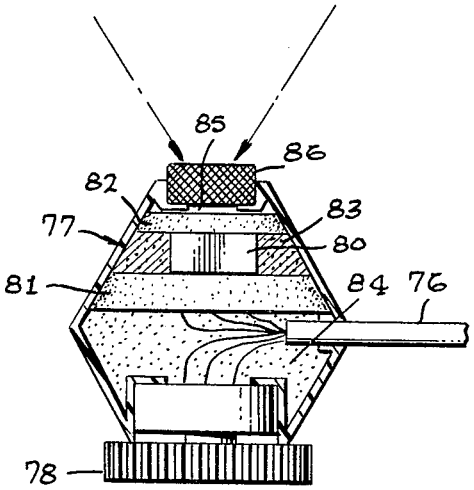
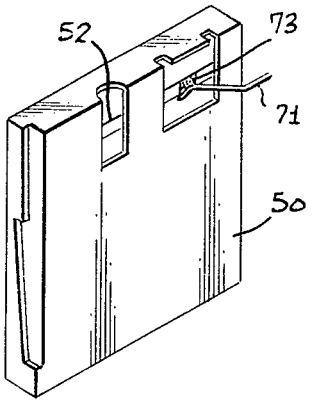
FIG. 12

PORTABLE SELF-CONTAINED AMPLIFIER AND LOUDSPEAKER APPARATUS

BACKGROUND OF THE INVENTION

1. Field of the Invention

This invention relates to electro-acoustical transducers and, more particularly, to a novel unitary amplifier and loudspeaker apparatus adapted to be carried on the person of a moving musician and capable of generating improved acoustical wave energy distribution.

2. Description of the Prior Art

In the past, it has been the conventional practice to arrange musicians of a marching band or group in a pattern of rows and columns so as to move as a unit in street parades, on football playing fields and the like. Although a variety of musical instruments have been adapted to be connected to electrical amplifiers for electrically amplifying signals generated by the instrument, such amplifiers are very heavy, bulky, and cumbersome and depend on an alternating current source so that it is impractical to provide amplifier and loudspeaker systems compatible with the mobility required of individuals in a marching band or choral group. Without such amplifying equipment, spectators on opposite sides of the street over which a marching band travels often experience musical voids or blanks where some of the instruments cannot be heard.

Furthermore, it is difficult for an individual musician in a marching band to hear the various parts being played by other musicians in the band as the band moves down the street or a playing field. For example, in a non-amplified marching band, the musicians in the second row very seldom hear the musical parts being played by musicians in the first or front row, while the musicians in the third row seldom hear the parts being played by musicians in the first and second rows and so forth.

A partial cause of musical selection blanking resides in a natural condition of imbalance between various classes of instruments in the group. Some instruments, such as those classed as brass, are considered strong in terms of loudness and extremely directional in sound propagation. Other instruments, such as woodwinds, are relatively weak and lack direction in sound radiating ability. This imbalance results in a band in which all voices thereof are comparatively unequal in both loudness and directional propagation.

Attempts have been made to provide portable loudspeaker systems such as the one disclosed in U.S. Pat. No. 2,676,207. However, sound wave propagation from the single sound radiator is not omnidirectional and the personal harness is not suitable for women and men alike.

Therefore, a need has long existed to provide an amplifying system including electro-acoustic transducers that is truly portable and compact so that the unit may be carried by each member of an instrumental or vocal group and that will incorporate acoustical wave energy propagation and distribution capable of being heard by a remotely located audience, by spectators on opposite sides of the group and by each individual band member.

Also, the system should obtain maximum efficiency and utilization from the least quantity of components.

SUMMARY OF THE INVENTION

Accordingly, the difficulties and problems encountered with conventional non-amplified bands or orchestras are obviated by the present invention which provides a portable, self-contained amplifier and loudspeaker apparatus adapted to be carried on the person of each individual band musician whereby equality of all instruments and voices in the band is attained. In one form of the invention, an open-ended, cylindrical housing defining a tone chamber is utilized which includes means for carrying the apparatus on the body of the musician. The housing mounts an electronic component package within the interior tone chamber thereof with a control panel of the package exteriorly exposed of the housing for access and control purposes. A pair of electro-acoustic transducers are provided which are separated by the tone chamber and are fixed to the opposite ends of the housing so as to seal and close the chamber thereof. The loudspeakers are arranged substantially back-to-back, separated by the tone chamber so that acoustic wave energy propagation radiates in opposite directions outwardly therefrom. The loudspeakers are connected to the amplifier in an acoustical out-of-phase relationship so that the loudspeaker vibrating cones operate in unison to provide maximum efficiency.

An opening is provided in the housing mid-way between its opposite ends so that sound is projected therethrough in response to back stroke of the loudspeaker cones. In this manner, 360 degree soundwave propagation or radiation is achieved.

Therefore, it is among the primary objects of the present invention to provide a novel amplifier and loudspeaker apparatus which is self-contained and capable of being carried on the person of a musician in a moving group such as a band or chorus.

Another object of the present invention is to provide a novel electro-acoustic transducer system for radiating acoustical wave energy in a predetermined pattern suitable for maximum effectiveness with respect to audiences on either side of the device as well as audiences which are far removed from the sound source.

Another object of the present invention is to provide a novel self-contained and portable amplifier and loudspeaker system which is relatively compact and that provides improved energy wave propagation in an environment where the audience is far removed from the sound and the apparatus is moving.

Still another object of the present invention is to provide a new and novel compact and portable combined amplifier and loudspeaker apparatus wherein the apparatus may be readily carried by members of a marching band and wherein the loudspeakers are so arrange on each apparatus that improved acoustical energy wave characteristics are realized which are not attainable in non-amplified systems.

Yet a further object of the present invention is to provide a novel combined amplifier and loudspeaker apparatus which provides the members of a musical group with the advantages and benefits of amplified music normally restricted to bands and orchestras remaining in place on a stage or platform.

A further object of the inventive concept resides in providing a novel electro-acoustic transducer apparatus having a pair of loudspeakers acoustically coupled together out-of-phase and serving as closures located at opposite ends of a sound or tone chamber and including an opening between the loudspeaker pairs for radiating sound on the back stroke of the speaker cones so as to provide maximum efficiency.

Another object is to provide a novel amplified sound system employing an elongated sound chamber with a grilled opening and a pair of loudspeakers connected at the chamber ends so as to operate in unison whereby the sound chamber provides improved efficiency characteristics by obviating creation of vacuum or pressure conditions.

Still another object of the invention resides in providing an amplifying system having loudspeakers connected out-of-phase acoustically so as to radiate energy via a grilled opening between the loudspeakers to propagate the energy in a 360 degree pattern as well as in an equi-distant relationship from the loudspeaker and opening combination.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

FIG. 1 is a perspective view of the novel portable amplifier and loudspeaker apparatus of the present invention illustrated in its carrying position on the back of a marching musician;

FIG. 2 is a perspective view of the loudspeaker apparatus and showing its carrying harness open preparatory to placing on the musician or the like;

FIG. 3 is a diagrammatic top plan view of the apparatus carried on the shoulders of a marching musician illustrating acoustical wave propagation patterns radiating from the loudspeakers mounted on the housing;

FIG. 4 is a sketch showing a front elevational view of the housing employed in the apparatus illustrating the degree of piece incline or angle;

FIG. 5 is a sketch similar to the sketch of FIG. 4 showing a top plan view of the apparatus housing illustrating the forward facing angle of the end pieces;

FIG. 11 is a transverse cross-sectional view of the apparatus as taken in the direction of arrows 11—11 of FIG. 10;

FIG. 12 is a perspective view of a tape cartridge and a start/stop control therefor; and FIG. 13 is a longitudinal cross sectional view of the novel microphone employed with the loudspeaker apparatus as shown in FIGS. 1 and 3.

DESCRIPTION OF THE PREFERRED EMBODIMENT

Figure 6:
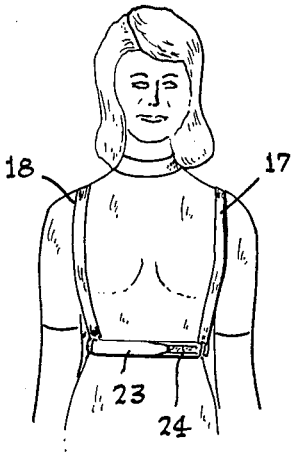
FIG. 6 is a front elevational view of the apparatus harness as shown in FIG. 2.

Referring to FIGS. 1 and 2, the novel amplifier and loudspeaker apparatus of the present invention is illustrated in the general direction of arrow 10 and, as shown in these figures, the apparatus is supported from the shoulders of a marching musician 11 so that a housing 12 of the apparatus rests against and is supported by the back of the musician. The apparatus comprises the elongated hollow cylindrical housing 12 which encloses and defines an elongated sound or tone chamber. The opposite ends of the housing 12, and hence the sound chamber, are closed by a pair of loudspeaker units 13 and 14, respectively. A central opening 15 is provided in the housing midway between its opposite ends and located at the rear of the housing provides a third "speaker" for the apparatus. The opening 15 is covered with a grill and represents a speaker in the sense that sound within the sound or tone chamber will pass therethrough. The housing 12 is supported from the shoulders or body of the musician by a harness means comprising a vertical backstrap 16 which joins with opposite ends of shoulder straps 17 and 18 that terminate at their opposite ends in snap fasteners 20 and 21, respectively. It can be seen that the opposite end of the back strap 16 from its end joining with the shoulder straps terminates in a pivotal hinge or arrangement 22 with the top of the housing 12. In this fashion, the gravitational force of housing will cause the housing to be supported solely from the shoulders of the musician.

It can also be seen that the harness means includes, as shown in FIG. 2, waist strap means having a belt portion or strap 23 and portion 24. Both portions are intended to encircle the waist of the musician and to releasably fasten at their free ends by a suitable buckle or adjustment means. Preferably, a "Velcro" fastening means may be employed so that registry of the two portions with respect to each other need not be required. The opposite ends of the belt portions 23 and 24 are hingeably connected to the ends of the housing 12 by folding the ends of the belt portions over upon themselves through a loop element and each of the arrangements is indicated by numerals 25 and 26, respectively. Vertical adjustment of the shoulder straps is readily achieved by the sliding or wedge fasteners 27 and 28 which provide a loop in the terminating ends of the shoulder straps 17 and 18 so as to receive and adjust the snap fasteners 20 and 21, respectively.

A feature of the housing 12 provides for a concave shaped plate 30 which rests against the back of the musician and the plate 30 is fastened to the housing by screws or fasteners 31 so as to close an access opening leading into the interior of the housing. Through this opening, maintenance and repair can be achieved as well as installation of the electronic components therein.

Referring now in detail to FIG. 3, it can be seen that the end speakers 13 and 14 are angularly disposed with respect to one another as carried on the ends of the housing 12. Preferably, the loud speakers on each end of the housing are angled upward at 10 degrees and forward at 20 degrees. By this means, a total 360 degree projection of sound is achieved from the housing 12. The 360 degree propagation is derived from the fact that each speaker 13 and 14 as well as the central opening 15 will project sound propagation of 120 degrees. Therefore, a full 360 degree projection of sound is achieved from the three speaker locations. A feature of the invention resides in the radiation of sound from the central opening 15. By wiring the loud speakers 13 and 14 "out of phase" acoustically, a combined or cooperative pumping action within the internal sound chamber is experienced. On the forward stroke of the speaker cones within the loud speaker units 13 and 14, the cones will pump outward and forward. On the rearward stroke of the cones, the cones pump the sound through opening 15. The elongation of the tone chamber within the housing 12 is such that it provides the proper back-pressure to project the sound from the rear speaker opening or grill 15 at the same velocity or power as that eminating from either of the end grills or loud speakers 13 and 14; thus, providing for uniform projection of sound over the full 360 degrees. Consequently, a feature of the invention resides in the fact that a pair of loud speaker units cooperate with one another to provide the functions and work of normally three loud speakers.

In FIG. 4, a diagram is provided showing the 10 degree angle of the loud speakers 13 and 14 when viewed in front elevation. In FIG. 5, a top plan view is sketched illustrating the 20 degree forward angle of the loud speakers 13 and 14.

Figure 7:
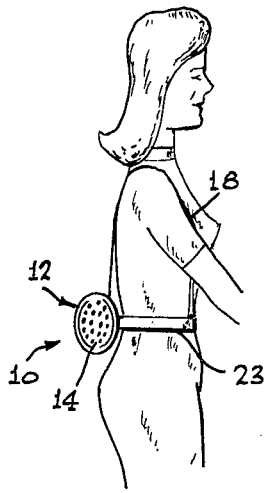
FIG. 7 is a side elevational view of the apparatus as shown in FIG. 1.

Referring now in detail to FIGS. 6 and 7, it can be seen that the harness means of the present invention is suitable for a variety of persons such as women, for example, so that the shoulder straps 17 and 18 pass along the sides of the breasts and do not interfere with the normal contour of the persons chest. The harness means fits all sizes of both male and female persons of a variety of sizes and shapes. As shown in FIG. 7, the housing 12 is supported directly from the shoulders of the wearer so that the weight is evenly distributed on the shoulders and is not introduced to the muscles or structure of the back.

Figure 8:
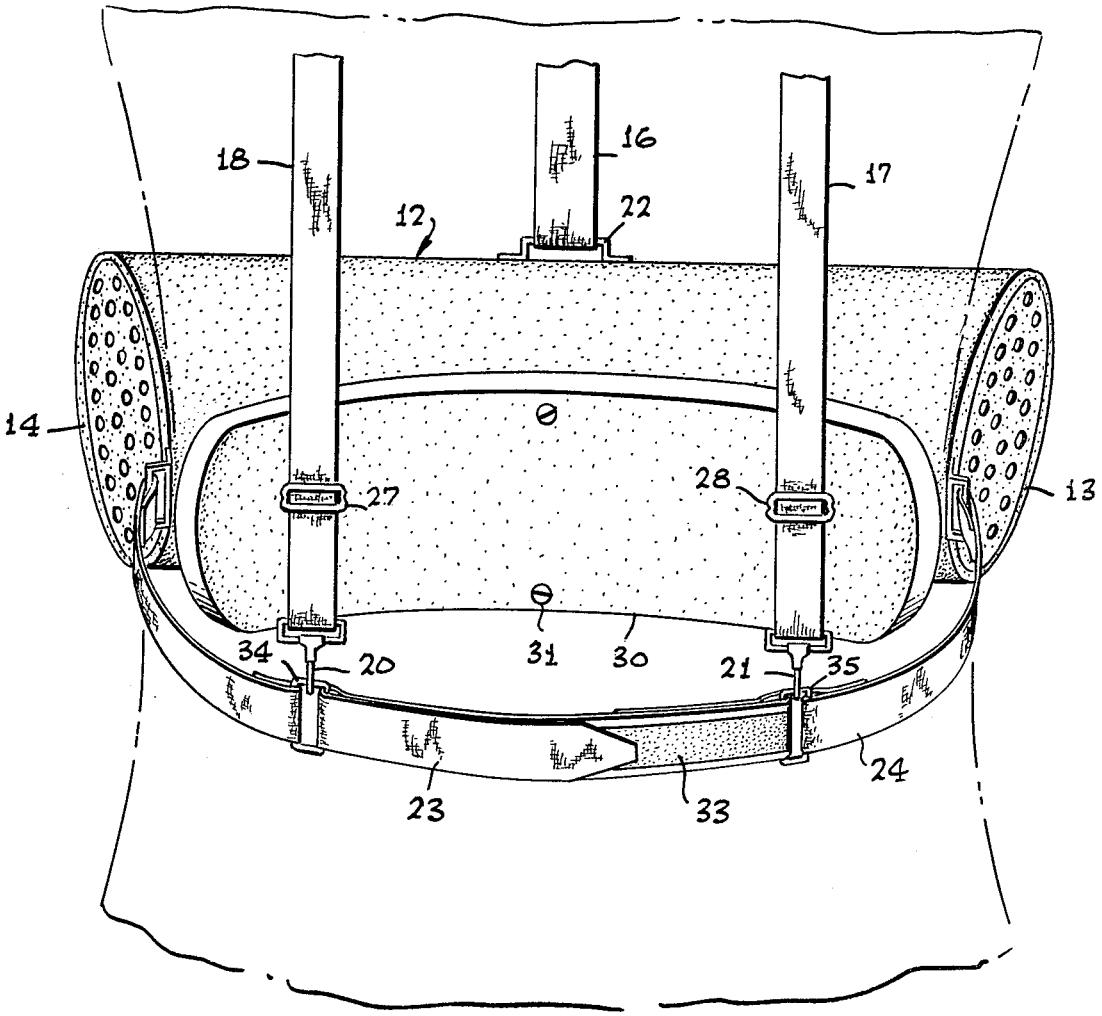
FIG. 8 is a front perspective view of the loudspeaker apparatus and harness as worn by a musician.

Referring now in detail to FIG. 8, the adjustment and attachment features of the harness means is illustrated. The housing 12 of the apparatus is carried carried at the small of the back of the wearer and the concave plate 30 bears against the small of the back at the waist of the wearer. The waist portions 23 and 24 are secured at their free ends by the hook and pile fastening means 33 which is manufactured and sold under the trade name "Velcro". Attachment to the free ends of the shoulder straps 17 and 18 is achieved by means of the snap fasteners 20 and 21 which snap about loops 34 and 35 carried on their respective belt portions 23 and 24. Strap adjusters 27 and 28 accommodate the height of the person's torso.

Figure 9:
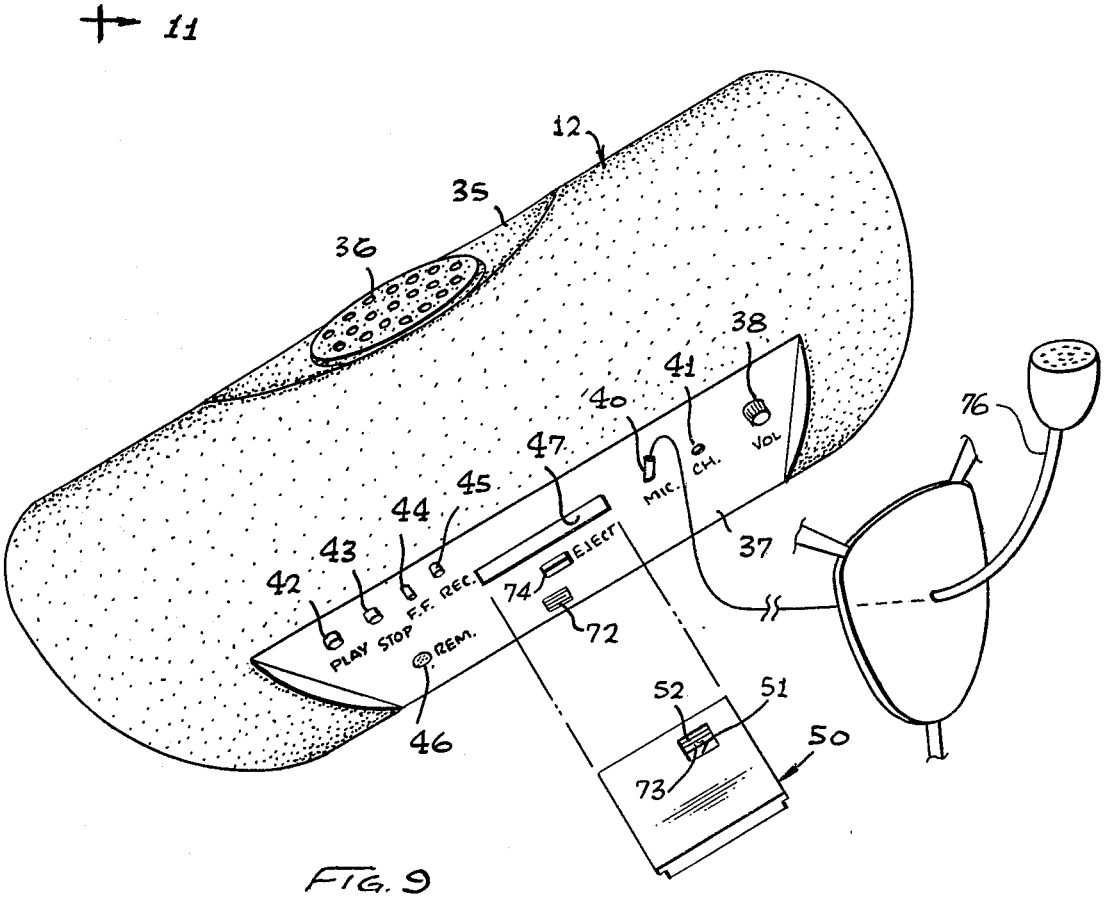
FIG. 9 is a bottom plan view, in perspective, of the loudspeaker housing illustrating the control panel and tape deck.

Referring now to FIG. 9, the housing 12 is illustrated as having a concave depression 35 at the rear thereof which supports a grill 36 closing the opening 15. Also, housing 12 includes an instrument panel 37 which is intentionally located on the underside or bottom of the housing so that it is protected from rain or direct water impingement directly thereon. The various operating switches may be manually activated by the hands of the wearer or musician and are exposed for this purpose. For example, a volume control is indicated by numeral 38 and a microphone jack is indicated by numeral 40. Since a tape recorder and playback unit is incorporated into the system enclosed by the housing 12, a jack for charging internal batteries is indicated by numeral 41. A start switch is represented by numeral 42 which is intended to commence operation of the tape recorder while button or switch 43 causes operation to cease. As is the conventional practice, a fast forward switch 44 is incorporated as well as a record button 45. In the event that other loud speakers or remote devices may be coupled into the system, a remote outlet 46 is provided. The control panel 37 further provides a slot 47 for insertably receiving a recording tape cartridge 50. The cartridge 50 includes a special window 51 exposing a portion of the tape 52 for actuating a novel start/stop electromechanical mechanism.

Figure 10:
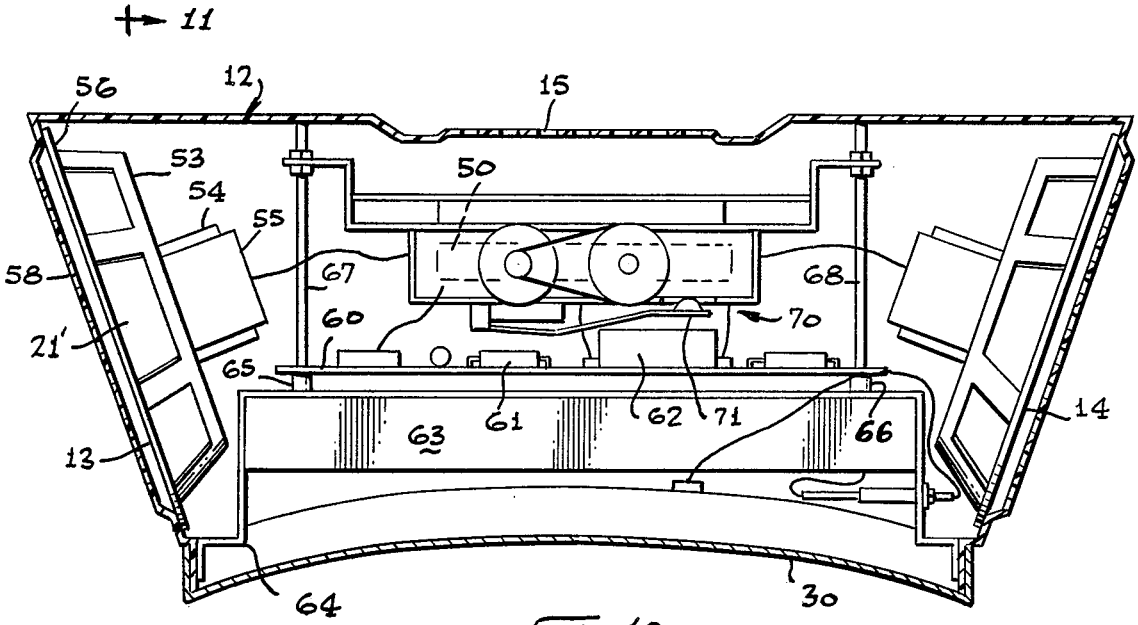
FIG. 10 is an enlarged top plan view of the apparatus illustrating the housing broken away to expose internal component parts and the sound grill.

As illustrated in detail in FIG. 10, the internal components of the system within the housing 12 are illustrated. It is to be understood that the components occupy the internal sound or tone chamber defined between the opposite ends of the housing as closed by the pair of loud speaker units 13 and 14, respectively. Each of the loud speaker units comprises a frame 53 supporting a magnet mount 54 for holding a permanent magnet 55. Each unit also includes a conventional vibrating cone or diaphragm 21' moveably carried on the frame so as to radiate acoustical wave energy when flexed, distorted or displaced. Each loud speaker unit is retained on its respective end of the housing by means of a retaining ring 56 which is fixed to the interior of the housing by a plurality of fastening means. A separate grill indicated by numeral 58 is integrally formed with the end of the housing 12 and includes a plurality of apertures or holes through which sound may pass from the loud speaker unit.

A feature of the invention resides in the provision of the internal sound or tone chamber defined by the housing 12 and the loud speaker units 13 and 14. With the loud speaker units 13 and 14 wired or connected "out-of-phase" acoustically, the speakers project the sound from the ends of the housing on the forward stroke of the cones, and the sound is projected outwardly through the rear grill 15 on the back stroke of the speaker cones. Thus, with the end speaker units angled forward at 20 degrees, the present apparatus will project the sound of musical instruments or audio evenly over 360 degrees. Should the end loud speakers be angled forwardly to 28 degrees, the human voice may be projected evenly over 360 degrees. Therefore, the air column within the interior sound or tone chamber moves back and forth in response to combined and simulateous movement of the cones. The effect of the air column movement is that neither vacuum nor pressure conditions are present so that the sound chamber and system functions at maximum efficiency.

FIG. 10 further illustrates that the electronic component package is mounted in the interior sound or tone chamber so that movement of the air column in response to cooperation of the loud speaker cones operates to remove heat from the components of the electronic package. Therefore, power supplies and power transistors as well as other components having heat sinks, are maintained in a cool atmosphere when the loud speakers are operating. The electronic component package comprises a circuit board 60 carrying a plurality of electronic components employed in a conventional amplifying circuit and such components are illustrated by numerals 61 and 62, respectively. A rechargeable battery pack 63 is carried on a sheet metal frame 64 which includes a plurality of individual battery cells. The sheet metal frame 64 is coupled to the housing 12 via suitable fastening means and the electronic circuit board 60 is carried on the frame 64 in spacial relationship therewith by spacers 65 and 66. Rods 67 and 68 further support the circuit board 60 and the battery pack within the interior tone chamber.

It is to be noted in FIG. 10 that a tape recorder 70 is included as part of the component structure in the tone chamber. The tape recorder 70 is of the capstan-type drive and includes a novel start and stop switch broadly indicated by the numeral 71. The tape cartridge 50 is shown in position within the tape recorder and play back arrangement 70 so that the window 51 is in close proximity and in registry with the switch 71. When the tape 52, which includes an insulation strip thereon, comes into contact with the switch 71, the electrical circuit is broken which causes the tape recorder to stop. Starting of the tape recorder is initiated by again depressing the start button carried on the control panel and indicated by numeral 72.

With emphasis on the tape recorder operation, it is to be understood that when recording, the foil as indicated by numeral 73 in FIG. 9 and FIG. 12 will stop the tape unit at the "end of the tape" and will actuate an audio signal having a high frequency sound indicating to the musician or operator that it is time to change the tape. When recording pre-recorded messages, the foil can be placed on the tape at the end of each message, as in the case of recording messages for each station on a privately conducted tour. Therefore, an entire multistation tour may be recorded on one tape. The foil can be omitted completely so as to allow a message to repeat over and over until the unit is stopped manually by pressing an eject button 74. If FIG. 12, the engagement of the switch 71 with the foil 73 is clearly shown so that an electrical circuit can be broken to cause de-actuation of the tape motor.

In FIG. 11, it can be seen that all of the electronic component parts are within the interior tone chamber of the housing 12 and therefore as the air moves back and forth between the opposite ends of the housing, a cooling effect takes place over the component parts. Also, it can be seen that the control panel 37 is located on the underside of the housing 12 and that the control downwardly depend from the control panel 37. The tape recorder is located with its slot 47 in the control panel 37 so that the cartridge 50 may be readily inserted therethrough into position for being played. The capstan and its drive are automatically operated so that the capstan, indicated in general with its drive by numeral 75, will cause the tape to operate.

The amplifier of the present invention is operated by plugging a microphone into the jack 40 on the control panel 37. The microphone is preferably carried on the end of a boom 76 as shown in FIG. 13. The microphone component parts are disposed and arranged within a housing 77 which includes a resistor-type volume control operated by knob 78. The active element in the microphone is of the Electret type and is indicated by numeral 80 which is surrounded by a plurality of foam pads such as is indicated by numerals 81, 82 and 83. In this manner, the microphone element 80 is floating on a foam cushion. Foam block 84 fully supports the element and keeps the element from engaging with the volume control 78. The microphone element 80 is intended to pick up sound coming in the direction of the arrows. In this manner, sound is selectively introduced through an aperture 85 in the housing 77 so that only the operators voice will activate the microphone. A suitable screen 86 is provided for protecting the aperture 85. As shown in FIG. 3, the microphone is close to the mouth of the wearer and is out of the sound eminating range of the loud speakers 13 and 14. Therefore, it can be seen that the microphone element is not only positioned immediately in front of the mouth of the user but is fully encased in a foam such as polyurethane so as to make it shock resistant and less "microphonic". The specially designed housing provides a tight conical pattern to the microphone input as indicated by the arrows.

In view of the foregoing, it can be seen that the amplifier and loud speaker apparatus of the present invention provides a novel housing for component parts and loud speaker units permitting full amplification of electronic signals generated by the voice or musical instruments. All voices of the group are equally balanced with respect to loudness and direction. The apparatus is light in weight and may be carried on the body of the musician and therefore is portable in a true sense so that members of the group may be completely outfitted with the apparatus for full band or choir amplification. The directional characteristics of acoustical energy is greatly improved over non-amplified bands and bears a direct relationship to the arrangement of loud speaker units on the apparatus. It is to be understood that although amplified signals from an electronic musical instrument has been emphasized, the present invention includes amplified voice projection as well. This latter application includes both speech and song vocalizing unaccompanied or accompanied by musical selections.

The component parts are maintained in a cool condition since the heat generated by the components is dissipated as the air column moves back and forth between the pair of speakers. Three hundred and sixty degree sound radiation or propagation is experienced due to the location of the speakers and particularly with respect to the grilled opening 15 on the housing 12. Tape recorder operation is improved by the use of the aforementioned foil 73 wrapped around the tape 50 and engaged by the start/stop mechanism 71. The controls are conveniently located beneath the housing on the control panel 37 and the controls may be readily operated by the hands of the wearer while the unit is being worn. The support harness provides that the weight of the unit is directly on the shoulders and the harness straps are readily adaptable to fit a variety of persons.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An amplifier and loudspeaker apparatus adapted to be carried on the body of a person using a sound source generating electrical signals comprising the combination of:

a housing having an internal sound chamber occupied by an air column;

a pair of loudspeaker units secured to said housing in fixed spaced apart relationship, each of said loudspeaker units facing in opposite directions so that said air column moves in unison with said loudspeakers;

said housing having a sound opening midway between said loudspeakers for radiating acoustical energy via said air column;

an electronic component package including electrical amplification components secured to said housing within said internal sound chamber and disposed between said loudpseaker units; and means operably connecting said electrical amplification components to said sound source and to said loudspeaker units for energizing said loudspeaker units and moving said air column so as to generate acoustical energy in a predetermined propagation pattern from said housing opening and from said loudspeaker units in response to amplified sound source electrical signals;

said pair of loudspeakers are intentionally connected out-of-phase acoustically whereby sound energy is radiated externally of said housing via said sound opening in response to the back stroke of said pair of loudspeakers.

2. The invention as defined in claim 1 wherein:

said housing is elongated and said loudspeakers are angularly disposed on the opposite ends of said housing.

3. The invention as defined in claim 2 wherein:

said end loudspeakers are angled upward at approximately 10 degrees and forward at approximately 20 degrees.

4. The invention as defined in claim 3 wherein:

said loudspeakers and said sound opening project sound radiation so that a full 360 degree radiation pattern is achieved therefrom.

5. The invention as defined in claim 1 wherein:

said loudspeakers include vibrating cones located at opposite ends of said air column and said air column movement in response to cooperative vibration of said cones.

6. The invention as defined in claim 5 including:

shoulder and waist strap means supporting said housing from the shoulders and waist of the user; said shoulder strap means includes an attachment to the top of said housing whereby said housing downward depends therefrom by gravity in a balanced manner.

7. The invention as defined in claim 6 wherein:

said shoulder strap means releasably attaches to said waist band outwardly offset from the breasts of the user.

8. The invention as defined in claim 7 wherein:

said predetermined propagation pattern substantially forms a circle with said housing in the center of said pattern whereby acoustical energy is dispensed into an area of approximately 360 degrees about said user.

9. The invention as defined in claim 1 wherein:

each of said loudspeaker units includes a vibrating cone and said cones are intentionally electrically coupled to said amplification components so that said cones operate out-of-phase acoustically whereby sound is radiated out of said sound opening on the back stroke of said loudspeaker cones.

10. In a sound amplification and sound propagation system adapted to be carried on the body of a person having a conventional DC amplifier and conventional vibrating cone loudspeakers, the combination comprising:

an elongated cylindrical hollow housing having a sound opening between its opposite ends;

said housing having each of its opposite ends closed by one of said loudspeakers so as to define a tone chamber therebetween occupied by an air column;

circuit means coupling each of said loudspeakers to said amplifier in a specifically and intentionally acoustical out-of-phase relationship so that said air column moves back and forth in response to movement of said loudspeakers in unison whereby acoustical energy radiates simultaneously from said loudspeakers and said sound opening to produce a predetermined propagation pattern covering approximately 360 degrees of radiation.

11. The invention as defined in claim 10 including:

strap means for supporting said housing about the shoulders and waist of the wearer.

12. The invention as defined in claim 11 wherein:

said loudspeakers are angled upward at 10 degrees and forward at 20 degrees.

13. The invention as defined in claim 12 including:

a microphone;

a boom for carrying said microphone in front of the user;

said microphone having a voice sensitive element carried in an enclosure;

said element supported on cushion material; and said enclosure having an opening leading to said element wherein said opening selectively receives activating voice signals to the exclusion of surrounding noises.

14. An amplifier and loudspeaker apparatus adapted to be carried on the body of a person using an instrument generating electrical signals comprising the combination of:

a housing having an internal sound chamber occupied by an air column;

a pair of loudspeaker units secured to said housing in fixed spaced apart relationship, each of said loudspeaker units facing in opposite directions so that said air column moves in unison with said loudspeakers;

said housing having a sound opening midway between said loudspeakers for radiating acoustical energy via said air column;

an electronic component package including electrical amplification components secured to said housing within said internal sound chamber and disposed between said loudspeaker units; and means operably connecting said electrical amplification components to said instrument and to said loudspeaker units for energizing said loudspeaker units and moving said air column so as to generate acoustical energy in a predetermined propagation pattern from said housing opening in response to amplified instrument electrical signals;

said pair of loudspeakers are connected out-of-phase acoustically whereby sound energy is radiated externally of said housing via said sound opening in response to the back stroke of said pair of loudspeakers;

said housing is elongated and said loudspeakers are angularly disposed on the opposite ends of said housing;

said end loudspeakers are angled upward at approximately 10 degrees and forward at approximately 20 degrees;

said loudspeakers and said sound opening project sound radiation 200 degrees so that a full 360 degree radiation pattern is achieved therefrom; and means attached to said housing for supporting said apparatus on the body of the user including adjustable shoulder straps and waist band.

15. The invention as defined in claim 14 including:

mounting means within said internal sound chamber for mounting said electronic component package whereby movement of said air column therewithin promotes cooling of said electronic component package.

* * * * *